US008317040B2

(12) United States Patent
Lanning

(10) Patent No.: US 8,317,040 B2
(45) Date of Patent: Nov. 27, 2012

(54) MAGNETIC DIVIDER SYSTEM

(76) Inventor: Terry Lanning, Ashton, IL (US)

( * ) Notice: Subject to any disclaimer, the term of this patent is extended or adjusted under 35 U.S.C. 154(b) by 454 days.

(21) Appl. No.: 12/082,163

(22) Filed: Apr. 9, 2008

(65) Prior Publication Data

US 2009/0255891 A1 Oct. 15, 2009

(51) Int. Cl.
*A47F 5/00* (2006.01)

(52) U.S. Cl. ..... 211/184; 211/DIG. 1; 206/561; 206/818; 108/60; 220/528; 220/529

(58) Field of Classification Search ..... 211/184, 211/175, 59.2, DIG. 1; 108/60, 61; 206/350, 206/561, 818, 557; 220/529, 534, 528; 248/206.5, 248/309.4

See application file for complete search history.

(56) References Cited

U.S. PATENT DOCUMENTS 1,928,512 A * 9/1933 Swift ..... 217/7
2,945,732 A * 7/1960 Edmondson, Jr. ..... 312/140.3
3,067,903 A 12/1962 Jones, Jr.
4,488,653 A * 12/1984 Belokin ..... 211/184
4,595,246 A * 6/1986 Bross ..... 312/348.3
5,054,668 A 10/1991 Ricchiuti
5,242,223 A * 9/1993 Koves ..... 312/348.3
5,257,693 A 11/1993 Kwasniak
5,449,081 A 9/1995 Sjostedt et al.
5,884,782 A * 3/1999 Dembicks ..... 211/70.6
6,073,766 A 6/2000 Winnard
6,073,794 A * 6/2000 Bidot ..... 220/529
6,357,844 B1 * 3/2002 Muterthies et al. ..... 312/348.3
6,614,337 B1 9/2003 Winnard
6,871,921 B2 3/2005 Ernst
2001/0004817 A1 * 6/2001 Auer ..... 52/238.1
2003/0184199 A1 10/2003 Jananji

OTHER PUBLICATIONS

Ernst Manufacturing, Inc. Tool Box Drawer Divider System. Installation instructions for Drawer Divider Kits.
International Search Report for International Application No. PCT/US 09/02212.

* cited by examiner

*Primary Examiner* — Teri P. Luu
*Assistant Examiner* — Devin Barnett
(74) *Attorney, Agent, or Firm* — Richard D. Harris

(57) ABSTRACT

A magnetic divider system for forming one or more sub-compartments to isolate and organize articles therewithin in the interior region of a compartment having a ferruginous surface is provided. The magnetic divider system includes at least one rail member for defining one or more sub-compartments in the interior region of the compartment, the rail members having a base portion, a distal portion, and a channel extending therethrough. The magnetic divider system further includes one or more attachment members comprising magnets for fixedly restraining the rail members in the interior region of the compartment. The attachment members are disposed in the channel to magnetically attract the ferruginous surface of the interior region of the compartment to, in turn, restrainably affix the at least one rail member to the ferruginous surface of the interior region of the compartment.

19 Claims, 5 Drawing Sheets

MAGNETIC DIVIDER SYSTEM

FIELD OF THE INVENTION

The present disclosure relates to systems for sub-dividing storage compartments for isolating and organizing articles therewithin.

BACKGROUND OF THE DISCLOSURE

Organized workspaces and storage areas are desirable in many professional and personal endeavors. Of course, requirements for organization vary with the size and material of which a space is constructed, and the size and number of the articles to be stored. Even with a given space and set of articles, such as a mechanic with hand tools and a tool chest, organizational needs and preferences may vary from person to person. Accordingly, a customizable organizational system which can accommodate a variety of storage spaces and articles is desirable.

SUMMARY OF THE INVENTION

The present disclosure provides a magnetic divider system for defining one or more sub-compartments to isolate and organize articles in the interior region of a compartment having a ferruginous surface. The magnetic divider system includes at least one rail member for defining one or more sub-compartments in the interior region of the compartment. The at least one rail member has a base portion and a distal portion. The base portion is capable of being juxtaposed to the ferruginous surface of the interior region of the compartment with the distal portion extending substantially normally away from the surface. The at least one rail member has a channel extending therethrough, the channel being proximate the base portion and spaced apart from the distal portion. The magnetic divider system further includes one or more attachment members for fixedly restraining the at least one rail member in the interior region of the compartment. The one or more attachment members comprise magnets and are disposed in the channel to magnetically attract the ferruginous surface of the interior region of the compartment and, in turn, restrainably affix the at least one rail member to the ferruginous surface of the interior region of the compartment. The at least one rail member defines at least one sub-compartment in the interior region of the compartment. Furthermore, the at least one rail member is capable of dividing the interior region of the compartment by itself as well as in cooperation with other like rail members. The at least one rail member is also capable of dividing the interior region of the compartment by engaging the ferruginous surface thereof and being free of engagement with all other surfaces thereof. Additionally, the at least one rail member is capable of being sized to a desired length, without pre-imposed modular limitations.

In some preferred embodiments, the magnetic divider system further comprises at least two of the rail members capable of being cooperatively configured to form one or more sub-compartments in the interior region of the compartment. The at least two rail members are fixedly restrained on the ferruginous surface of interior region of the compartment and arranged to intersect. The magnetic divider system can also comprise one or more cover fittings for further restraining the at least two rail members. The one or more cover fittings has a plan shape corresponding to an intersection of the at least two rail members and has a generally U-shaped cross-section complementary to the distal portions of the at least two rail members. The one or more cover fittings telescopically overlay the at least two rail members at the intersection and further secure the at least two rail members to each other.

In one preferred embodiment, the plan shape of the one or more cover fittings is an L-shape. The L-shape has a first cover segment and a second cover segment fixed at an ending of the first cover segment, with the first and second cover segments being substantially perpendicular to each other. Each of the first and second cover segments are capable of telescopically overlaying at least one of the rail members.

In another preferred embodiment, the plan shape of the one or more cover fittings is a T-shape. The T-shape has a first cover segment and a second cover segment fixed at a central portion of the first cover segment, with the first and second cover segments being substantially perpendicular to each other. Each of the first and second cover segments are capable of telescopically overlaying at least one of the rail members.

In yet other preferred embodiments, the plan shape of the one or more cover fittings is a cross-shape. The cross-shape has a first cover segment and a second cover segment fixed together at central portions thereof, with the first and second cover segments being substantially perpendicular to each other. Each of the first and second cover segments are capable of telescopically overlaying at least one of the rail members.

A preferred embodiment of the invention further calls for the plan shape of the one or more cover fittings in a Y-shape. The Y-shape has a first cover segment, a second cover segment, and a third cover segment fixed together at a junction. Each of the first, second, and third cover segments are capable of telescopically overlaying at least one of the rail members.

In a preferred embodiment, the one or more cover fittings include protrusions for restrainably engaging the rail members when telescopically overlaying the rail members. The protrusions extend inwardly from opposing positions of interior surfaces of the one or more cover fittings. Furthermore, the rail members include notches for receiving the protrusions. The notches are disposed at opposing positions in outer surfaces of the rail members. The protrusions and notches are capable of engaging and restraining the one or more cover fittings relative to the rail members when the one or more cover fittings telescopically overlays the rail members.

The channel of the at least one rail member preferably has a key-shaped cross-section which tapers in a direction from the distal portion toward the base portion. Furthermore, in some embodiments, the one or more attachment members have a key-shaped cross-section complementary to the key-shaped cross-section of the channel. In some embodiments, the channel bisects the base portion of the at least one rail member. Alternatively, in some embodiments, the channel is spaced apart from the base portion with the key-shaped cross-section of the channel extending wholly within the rail member. In the preferred embodiments, the one or more attachment members comprise permanent magnets.

In these embodiments also, the channel of at least one rail member extends continuously along the at least one rail member. The at least one rail member is capable of being sized to a desired length by a user, with the channel extending continuously over the desired length. In some embodiments, the distal portion of the at least one rail member has a rounded shape.

In a preferred embodiment, the compartment is a drawer having a ferruginous-surfaced drawer bottom. Furthermore, in this embodiment, the compartment is a metal drawer, such as a tool box drawer. Alternatively, in some embodiments, the compartment is a bed of a pick-up truck—or some other metal-bottom containment region.

The magnetic divider system further includes one or more end caps for covering an end surface of the at least one rail member. The one or more end caps have a plan shape corresponding to an length of the at least one rail member and have a generally U-shaped cross-section complementary to the distal portion of the at least one rail member. The one or more end caps telescopically overlay the at least one rail member and cover the end surface of the at least one rail member.

The present disclosure also provides a method of forming one or more sub-compartments to isolate and organize articles therewithin in the interior region of a compartment having a ferruginous surface. The method includes sizing at least one rail member to a desired length. The at least one rail member is capable of forming one or more sub-components in the interior region of the compartment. The at least one rail member has a base portion and a distal portion and also has a channel extending therethrough along the desired length. The channel is proximate the base portion and spaced apart from the distal portion. The method further includes positioning the at least one rail member in the interior region of the compartment with the base portion juxtaposed to the ferruginous surface of the interior region of the compartment with the distal portion of the at least one rail member extending substantially normally away from the ferruginous surface of the interior region of the compartment. The method further includes inserting one or more attachment members into the channel. The one or more attachment members comprise magnets, and are capable of magnetically attracting the ferruginous surface of the interior region of the compartment. The method also includes restrainably affixing the at least one rail member to the ferruginous surface of the interior region of the compartment with the one or more attachment members and forming at least one usable sub-compartment with the at least one rail member. The at least one rail member is capable of dividing the interior region of the compartment by itself as well as in cooperation with other rail members. The at least one rail member is also capable of dividing the interior region of the compartment by engaging the ferruginous surface thereof and being free of engagement with all other surfaces thereof.

In a preferred embodiment, the method further includes positioning at least two of the rail members with the base portions juxtaposed to the ferruginous surface of the interior region of the compartment and the distal portions extending substantially normally away from the ferruginous surface of the interior region of the compartment. In this embodiment, the method also includes intersecting the at least two rail members on the ferruginous surface of the interior region of the compartment and providing one or more cover fittings for further restraining the at least two rail members. The one or more cover fittings have a plan shape corresponding to an intersection of the at least two rail members and have a generally U-shaped cross-section complementary to the distal portions of the at least two rail members. The method also includes telescopically overlaying the one or more cover fittings on the intersection of the least two rail members and securing the at least two rail members to each other.

In some embodiments, the plan shape of the one or more cover fittings is an L-shape. The L-shape has a first cover segment and a second cover segment fixed at an ending of the first cover segment, with first and second cover segments being substantially perpendicular to each other. Each of the first and second cover segments are capable of telescopically overlaying at least one of the rail members.

In other embodiments, the plan shape of the one or more cover fittings is a T-shape. The T-shape having a first cover segment and a second cover segment fixed at a central portion of the first cover segment, with the first and second cover segments being substantially perpendicular to each other. Each of the first and second cover segments are capable of telescopically overlaying at least one of the rail members.

In yet other embodiments, the plan shape of the one or more cover fittings is a cross-shape. The cross-shape has a first cover segment and a second cover segment fixed together at central portions thereof, with the first and second cover segments being substantially perpendicular to each other. Each of the first and second cover segments are capable of telescopically overlaying at least one of the rail members.

In further embodiments, the plan shape of the one or more cover fittings is a Y-shape. The Y-shape has a first cover segment, a second cover segment, and a third cover segment fixed together at a junction. Each of the first, second, and third cover segments are capable of telescopically overlaying at least one of the rail members.

In one preferred embodiment, the method further includes restrainably engaging the one or more cover fittings with the at least two rail members when the one or more cover fittings telescopically overlays the at least two rail members. In this embodiment, the method also includes engaging protrusions of the one or more cover fittings with notches in the at least two rail members. The protrusions extend inwardly from opposing positions of interior surfaces of the one or more cover fittings, and the notches are disposed at opposing positions in outer surfaces of the at least two rail members.

In a preferred embodiment also, the channel has a key-shaped cross-section, which tapers in a direction from the distal portion toward the base portion. In some embodiments, the one or more attachment members have a key-shaped cross-section complementary to the key-shaped cross-section of the channel. In some embodiments, the channel bisects the base portion. Alternatively, in some embodiments, the channel is spaced apart from the base portion with the key-shaped cross-section of the channel extending wholly within the rail member. In these embodiments, the one or more attachment members comprise permanent magnets.

Preferably, the method further includes sizing the at least one rail member to the desired size for dividing the interior region of the compartment into sub-compartments by cutting the at least one rail member to the desired size. In these embodiments, the channel may be extended continuously along the at least one rail member with the at least one rail member capable of being sized to the desired size and having the channel extend continuously.

In a preferred embodiment also, the compartment is a drawer having a ferruginous-surfaced drawer bottom. In these embodiments, the compartment is a metal drawer. Preferably, the compartment is a tool box drawer. Alternatively, in some embodiments, the compartment is a bed of a pick-up truck—or some other metal-bottom containment region capable of magnetic cooperation with the attachment magnets.

In some embodiments of the invention, the magnetic divider system further includes one or more end caps for covering an end surface of the at least one rail member. The one or more end caps have a plan shape corresponding to an length of the at least one rail member and have a generally U-shaped cross-section complementary to the distal portion of the at least one rail member. The one or more end caps telescopically overlay the at least one rail member and cover the end surface of the at least one rail member.

Further objects and advantages of the present disclosure, together with the organization and manner of operation thereof, will become apparent from the following detailed description when taken in conjunction with the accompanying drawings.

DETAILED DESCRIPTION

Figure 1:
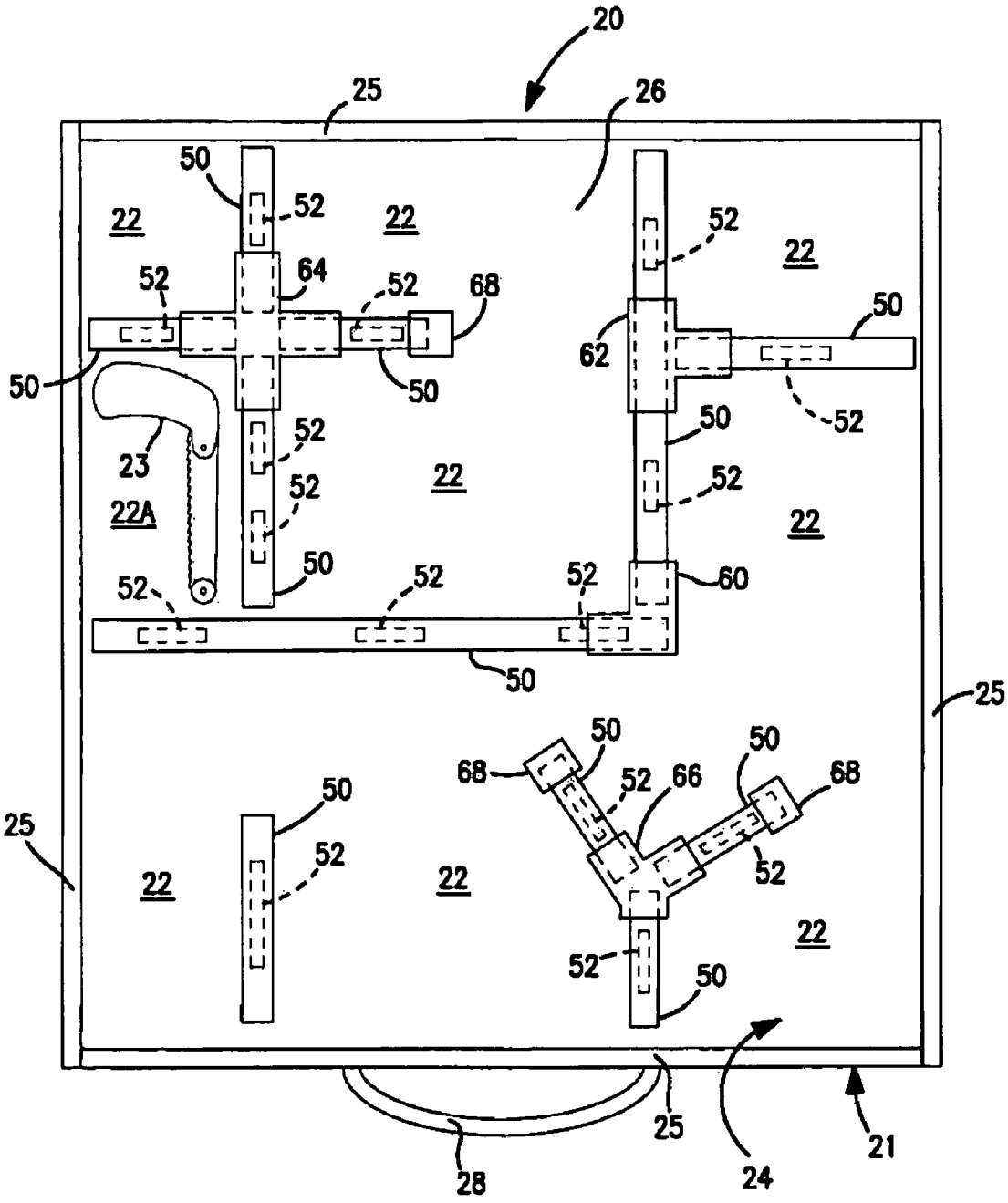
FIG. 1 of the drawings is a top plan view of an exemplary magnetic divider system partitioning the interior region of a compartment into a plurality of sub-compartments, according to the principles of the present disclosure.

The present disclosure is further described with reference to the accompanying drawings, which show particular embodiments of the disclosure. However, it should be noted that the accompanying drawings are merely exemplary. For example, the various elements and combinations of elements described below and illustrated in the drawings can vary to result in embodiments which are still within the spirit and scope of the present disclosure.

With reference to FIG. 1, exemplary magnetic divider system 20 partitions compartment 21 into a plurality of sub-compartments 22 capable of isolating and organizing articles therewithin. As illustrated, compartment 21 is in the form of a drawer, such as for storing hand tools, such as hacksaw 23 in sub-compartment 22A. It should be understood that a magnetic divider system according to the principles of a present disclosure can have a variety of applications, such as dividing a drawer (as shown) or the bed of a pick-up truck into sub-compartments capable of isolating and organizing articles such as tools. Compartment 21 includes interior region 24 bounded by a plurality of sidewalls 25 and ferruginous bottom surface 26. It should be further understood that, as used herein, the term "ferruginous" refers to being of, containing, or being similar to iron, such as being magnetically attracted to a permanent magnet in the same manner as iron or an iron-containing body. Being in the form of a drawer, compartment 21 further includes handle 28 extending from the outside of one of sidewalls 25.

With continued reference to FIG. 1, exemplary magnetic divider system 20 includes a plurality of rail members 50, supported on bottom surface 26, for dividing interior region 24 and forming usable sub-compartments 22. Each of rail members 50 is sized to a desired length. For example, a user can cut one of rail members 50 to correspond with a tool, and form a sub-compartments to store the tool. As described in more detail herein, rail members 50 are configured facilitate this functionality.

Magnetic divider system 20 further includes one or more attachment members 52 inserted in each of rail members 50, as also illustrated in FIG. 1. Attachment members 52 comprise permanent magnets which can magnetically attract bottom surface 26 when inserted into rail members 50 and, in turn, restrainably affix rail members 50 to bottom surface 26. The particular configuration attachment members 52, and the interaction between rail members 50 and attachment members 52, are both explained in more detail herein. It should be understood that the number of attachment members for a magnetic divider system according to the principles of the present disclosure can vary according to the specific applications or user preferences.

Still referring to FIG. 1, magnetic divider system 20 also includes a plurality of cover fittings for engaging and supporting rail members 50. As also described in more detail herein, the cover fittings telescopically overlay one or more of rail members 50 to enhance the security and stability of magnetic divider system 20. Accordingly, the cover fittings can have a variety of configurations, including those corresponding to intersections between rail members 50. By way of non-limiting example, the cover fittings of magnetic divider system 20 include L-shaped cover 60, T-shaped cover 62, cross-shaped cover 64, Y-shaped cover 66, and end caps 68. It should be understood that cover fittings for use with magnetic divider system 20 can have a variety of other shapes and configurations. It should also be understood that a magnetic divider system according to the principles of the present disclosure can function with or without cover fittings.

Figure 2A:
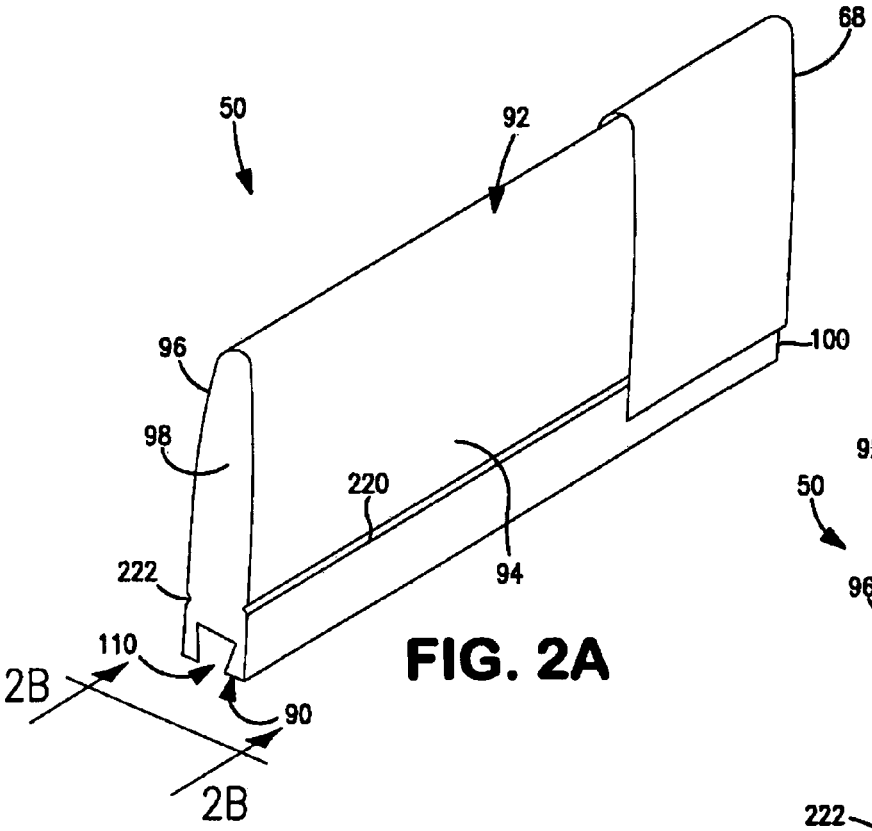
FIG. 2A is a perspective view of an exemplary rail member according to the principles of the present disclosure showing an end cap positioned thereon.
Figure 2B:
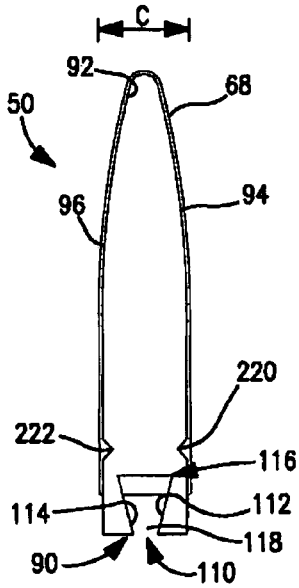
FIG. 2B is an end view of the rail member of FIG. 2A taken along lines 2B and looking in the direction of the arrows.
Figure 2C:
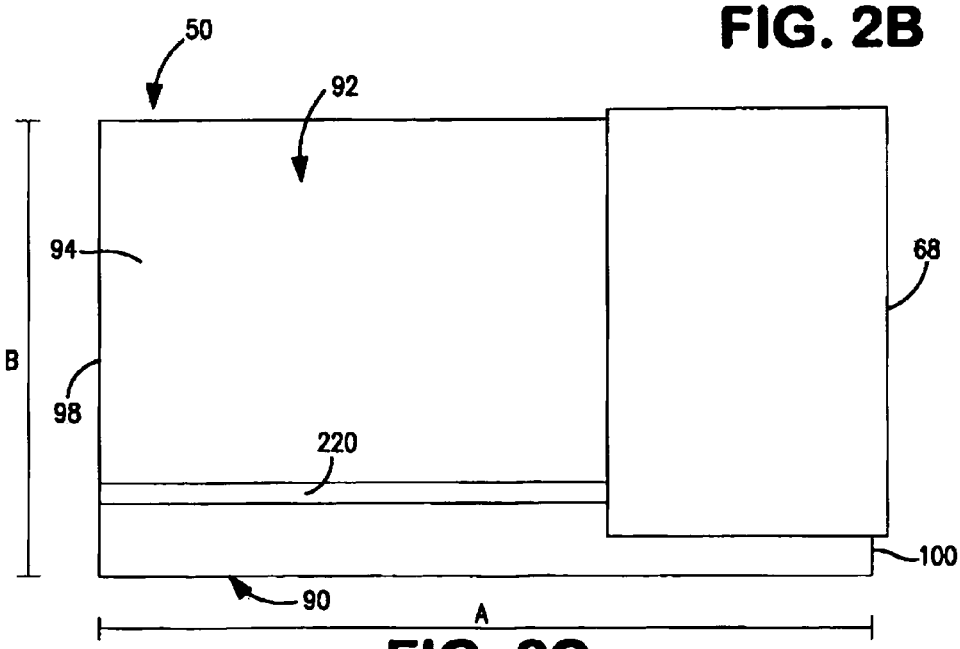
FIG. 2C is a side view of the rail member of FIG. 2A.

Referring to FIGS. 2A-2C, one of rail members 50 is illustrated in detail. It should be understood that, while a single one of rail members 50 is illustrated and described with reference to FIGS. 2A-2C, the illustration and description of rail member 50 applies equally to all of rail members according to the principles of the present disclosure, unless otherwise noted herein. Furthermore, it should be understood that FIGS. 2A-2C and the description of rail member 50 is exemplary in nature, and that rail members can vary according to the principles of the present disclosure.

Rail member 50 has a generally elongated and narrow shape, defining length A, height B, and width C. Rail member 50 defines base portion 90 and distal portion 92 opposite base portion 90, both extending along length A. Rail member 50 further includes first outer surface 94 and second outer surface 96 on opposing sides thereof. First and second outer surfaces 94, 96 extend between base portion 90 and distal portion 92 and along length A. Rail member 50 also includes first end surface 98 and second end surface 100 opposing each other. First and second end surfaces 98, 100 extend between base portion 90 and distal portion 92 and along width C. As illustrated, width C tapers along height B. In particular, rail member 50 is rounded at distal portion 92 and tapers outwardly toward base portion 90. As described in more detail below, this configuration of rail member 50 facilitates the telescopic engagement of the rail members and cover fittings according to the principles of the present disclosure.

Referring in particular to FIGS. 2A and 2B, rail member 50 further includes channel 110 extending therethrough along length A. Channel 110 has a generally key-shaped cross-section including first angled surface 112 and second angle surface 114. First and second angled surfaces 112, 114 are configured opposite each other such that the key-shaped cross-section of channel 110 includes tapered section 116, which tapers inwardly toward base portion 90. Channel 110 also bisects base portion 90, defining base aperture 118. Channel 110 extends continuously through rail member 50, maintaining a uniform cross-sectional shape therealong. Therefore, for any desired size of rail member 50, a continuous, uniform channel 110 is provided for receiving attachment members 52, as described in more detail below. It should be understood that channel 110 can have a variety of configurations, including a variety of cross-sectional shapes and positions relative to the base portion of the rail member.

Figure 3A:
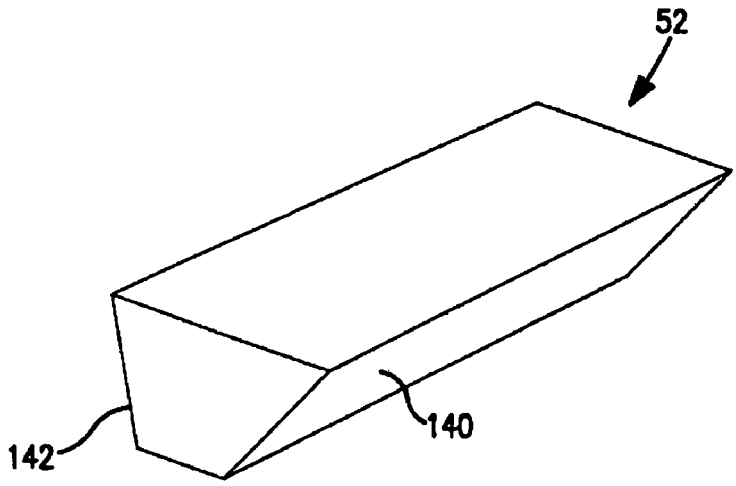
FIG. 3A is a perspective view of an exemplary permanent magnet attachment member according to the principles of the present disclosure.
Figure 3B:
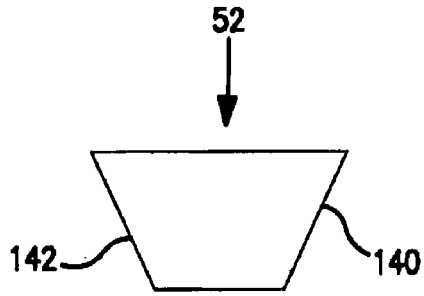
FIG. 3B is an end view of the attachment member of FIG. 3A.
Figure 3C:
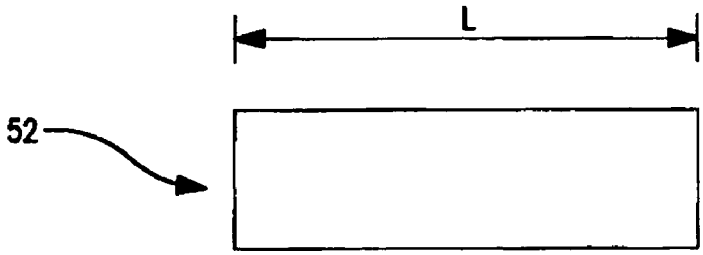
FIG. 3C is a side view of the attachment member of FIG. 3A.

With reference to FIGS. 3A-3C, one of attachment members 52 is illustrated in detail. It should be understood that, while a single one of attachment members 52 is illustrated and described with reference to FIGS. 3A-3C, the illustration and description of the single attachment member 52 applies equally to all of attachment members according to the principles of the present disclosure, unless otherwise noted herein. Furthermore, it should be understood that FIGS. 3A-3C and the description of attachment member 52 is exemplary in nature, and that attachment members can vary according to the principles of the present disclosure.

Attachment member 52 is shaped to be complementary to channel 110 of rail member 50, so that a user can restrainably insert attachment member 52 into channel 110 when using magnetic divider system 20. In particular, attachment member 52 has a substantially uniform cross-section, along length L, having a trapezoidal or key-shape complementary to the key-shaped cross-section of channel 110 of rail member 50. Attachment member 52 includes first angled surface 140 and second angled surface 142 corresponding to first and second angled surfaces 112, 114 of channel 110.

Figure 5A:
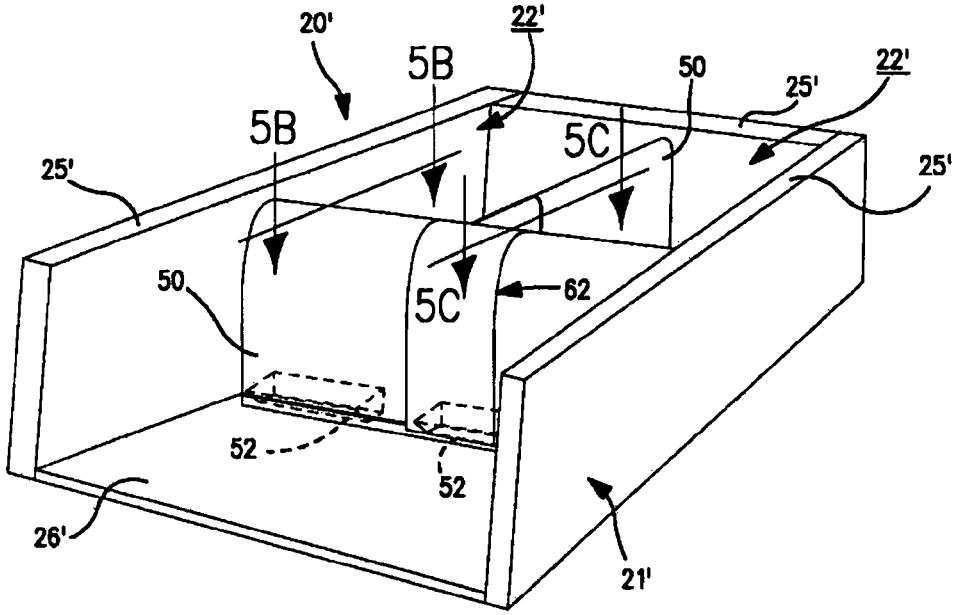
FIG. 5A is a perspective view of another exemplary magnetic divider system partitioning the interior region of a compartment according to the principles of the present disclosure.
Figure 5B:
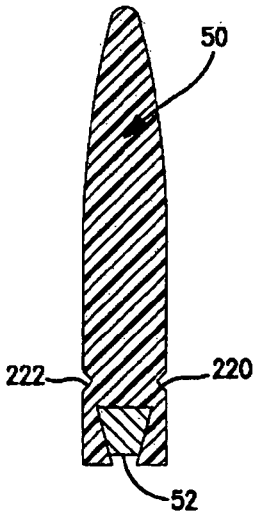
FIG. 5B is a cross-sectional view of a rail member and attachment member of the magnetic divider system of FIG. 5A taken along lines 5B.
Figure 6:
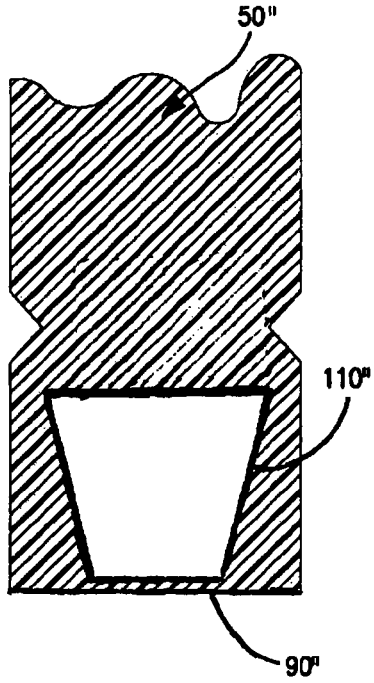
FIG. 6 is a partial cross-sectional view of another exemplary rail member according to the principles of the present disclosure.

With additional reference to FIGS. 5B and 6B, when attachment member 52 is received within channel 110 of rail member 50, and when first and second angled surfaces 140, 142 of attachment member 52 engage first and second angled surfaces 112, 114 of channel 110, attachment member 52 is inhibited from displacement towards base portion 90 of rail member 50 (and out of channel 110). Attachment member 52 comprises a permanent magnet or magnets, and, according to the principles of the present disclosure, is capable of magnetically attracting ferruginous bottom surface 26. Therefore, when attachment member 52 is inserted into channel 110 of rail member 50 and rail member 50 is positioned in interior region 24 of compartment 21 with base portion 90 juxtaposed to bottom surface 26, attachment member 52 magnetically attracts bottom surface 26 and, in turn, restrainably affixes rail member 50 to bottom surface 26, as the engagement between attachment member 52 and tapered section 116 of channel 110 of rail member 50 restrains attachment member 52 within channel 110. As such, magnetic divider system 20 is capable of functioning with one or more stand-alone rail members which do not engage any other surfaces of compartment 21 or utilize any cover fittings.

Referring again to FIG. 1, a varying number of attachment members 52 can be associated with each of rail members 50, and attachment members can be variably positioned within rail members 50. Furthermore, attachment members 52 can have varying lengths. Therefore, a user can tailor magnetic divider system 20 to specific requirements and/or preferences. For example, if a particular one of rail members 50 requires relatively strong holding strength, multiple and/or relatively long attachment members 52 can be utilized. Additionally, because of the consistent cross-sectional shapes of attachment members 52 and channel 110 of each of rail members 50, a user of magnetic divider system 20 can utilize any one of attachment members 52 with any rail member 50, and vice versa.

Figure 4A:
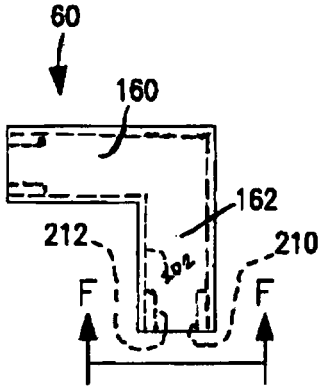
FIG. 4A is a plan view an L-shaped exemplary cover fitting according to the principles of the present disclosure.

Referring to FIGS. 1 and 4A-4F, various exemplary cover fittings according to the principles of the present disclosure are illustrated in detail. With particular reference to FIG. 4A, L-shaped cover 60 includes first cover segment 160 and second cover segment 162. First and second cover segments 160, 162 are fixed together at respective ends thereof, and are arranged to be substantially perpendicular to each other.

Figure 4B:
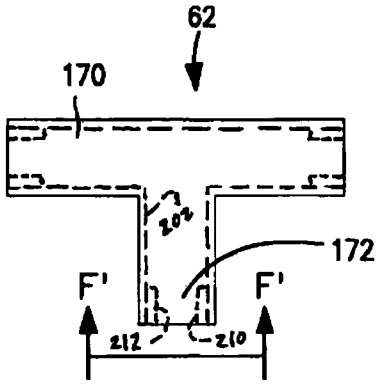
FIG. 4B is a plan view of a T-shaped exemplary cover fitting according to the principles of the present disclosure.

Referring in particular to FIG. 4B, T-shaped cover 62 includes first cover segment 170 and second cover segment 172. Second cover segment 172 is fixed to a central portion of first cover segment 170 and extends substantially perpendicularly away from first cover segment 170.

Figure 4C:
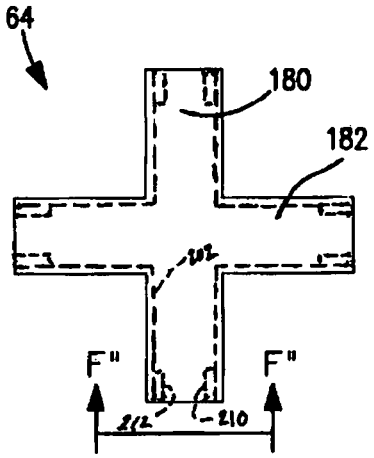
FIG. 4C is a plan view of a cross-shaped exemplary cover fitting according to the principles of the present disclosure.

Cross-shaped cover 64 is illustrated in FIG. 4C. Cross-shaped cover 64 includes first cover segment 180 and second cover segment 182 fixed together at central portions thereof. First and second cover segments 180, 182 are also arranged to be substantially perpendicular to each other.

Figure 4D:
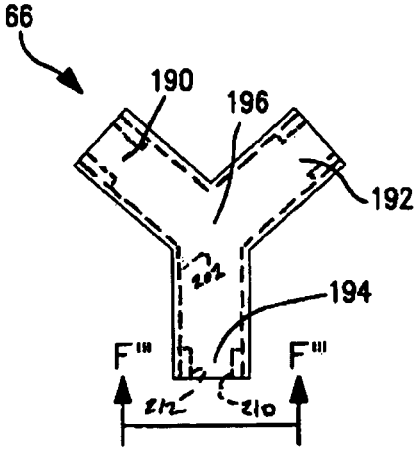
FIG. 4D is a plan view of a Y-shaped exemplary cover fitting according to the principles of the present disclosure.

With reference to FIG. 4D, Y-shaped cover 66 includes first cover segment 190, second cover segment 192, and third cover segment 194. First, second, and third cover segments 190, 192, 194 are fixed together at a single junction 196 and extend away from junction 196 in different directions.

Figure 4E:
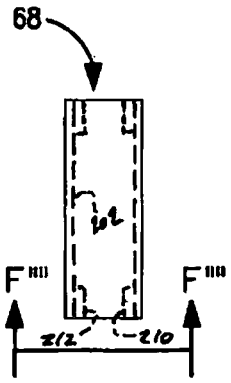
FIG. 4E is a plan view of an exemplary cover fitting in the form of an end cap according to the principles of the present disclosure.

Referring to FIG. 4E, as well as FIGS. 2A-2C, linear member 68 is illustrated in detail. Linear member 68 can be in the form of an end cap for engaging a single rail. Such an end cap can close off channel 110 of rail member 50 through optional end wall 198, to protect the end of rail member 50 from wear and/or other damage. Furthermore, referring solely to FIG. 4E, linear member 68 can also be in the form of a linear coupler having two open ends and capable of securing two rail members together end-to-end, in the absence of end wall 198.

Figure 4F:
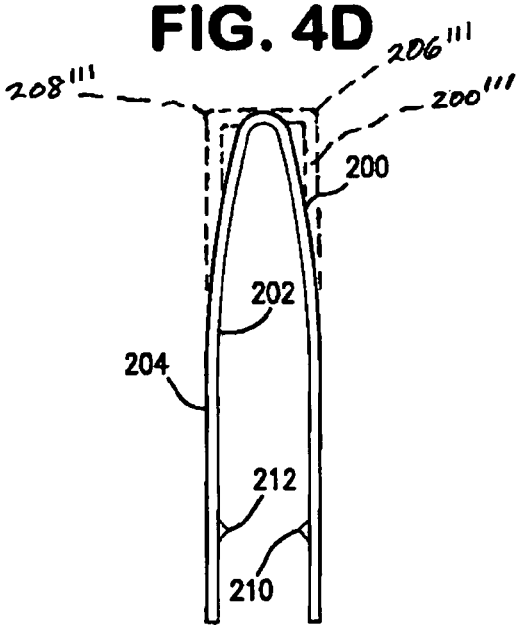
FIG. 4F is an end view of a segment of the cover fittings of FIGS. 4A-4E.

With reference to FIG. 4F, exemplary shapes of the segments of the cover fittings according to the principles of the present disclosure are illustrated. In one embodiment, each segment of the cover fittings has a generally thin inverted U-shaped body 200 defining inner surface 202 and outer surface 204. With additional reference to FIGS. 5B and 5C, U-shaped body 200 is shaped so as to be complementary to the rounded distal portion 92 of rail members 50. In an alternative embodiment, the segments have a body 200''' defining generally square corners 206''' and 208'''. The shape of body 200''' may simplify the manufacturing of the cover fittings, with improved structural rigidity.

Each of the segments of the cover fittings has protrusions 210, 212 extending inwardly from opposing portions of inner surface 202. As illustrated in FIGS. 4A-4E, these protrusions 210, 212 are positioned proximate to the outer ends of each segment, and extend along only a portion of each inner surface 202. Also referring to FIGS. 2A-2C, rail members 50 have notches 220 and 222 formed in opposing portions of first and second outer surfaces 94, 96, respectively, which are capable of receiving protrusions 210, 212. As protrusions 210, 212 extend only partially along each inner surface 202, only a portion of each segment is required to flex before eventually nesting in the notches of rail members 50 upon assembly.

Figure 5C:
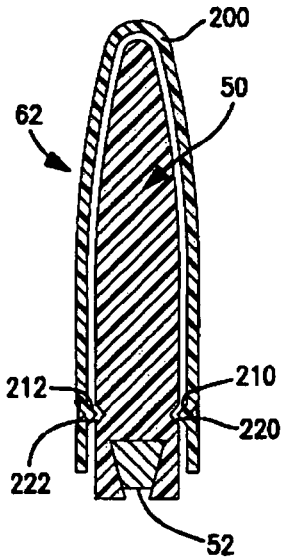
FIG. 5C is a cross-sectional view of a rail member, attachment member, and cover fitting of the magnetic divider system of FIG. 5A taken along lines 5C.

With particular reference to FIG. 5C, when a cover fitting is engaged with one or more rail members 50, U-shaped body 200 telescopically overlays rail member 50 with inner surface 202 of U-shaped body 200 being juxtaposed to first and second outer surfaces 94, 96 of rail member 50. Protrusions 210, 212 engage with notches 220, 222 to restrain U-shaped body 200 and, thus, the cover fitting relative to rail member 50. When a cover fitting with multiple segments—such as L-shaped cover 60, T-shaped cover 62, cross-shaped cover 64, or Y-shaped cover 66—is engaged with multiple rail members 50, the cover fitting is restrained relative to each of the rail members 50, and, therefore, the multiple rail members 50 are secured relative to each other.

With reference to FIG. 5A, an exemplary alternative configuration of a magnetic divider system according to the principles of the present disclosure is illustrated. Magnetic divider system 20' has two rail members 50 and T-shaped cover 62 dividing compartment 21'. Additionally, with reference to FIG. 6, an exemplary alternative rail member 50" according to the principles of the present disclosure is illustrated. Rail member 50" includes channel 110" extending therethrough. Channel 110" is spaced apart from base portion 90" of rail member 50", and, thus, the cross-section of channel 110" is wholly within rail member 50". It should be understood that the foregoing drawings and descriptions of particular components also apply to these alternative configured magnetic divider systems and, as such, are not repeated herein.

As exemplified herein, the present disclosure can vary in many ways. For example, it should be understood that a magnetic divider system according to the principles of the present disclosure can be used in a variety of applications. Moreover, a magnetic divider system according to the present disclosure can have a single rail member and/or a plurality of rail members in cooperation, can have a varying number of attachment members associated with each rail member, and/or can optionally include cover fittings at either the ends or the intersections of rail members. Additionally, the materials and shapes of the components of a magnetic divider system according to the principles of the present disclosure can vary. By way of example, the rail members can be made of wood, plastic, or metal materials, as can the cover fittings. In a preferred embodiment of the invention, both the rail members and the cover fittings are made of a lightweight polymeric or plastic material, such as polyethylene or polystyrene, by way of non-limiting example. Accordingly, it is to be understood that the present disclosure is exemplary in nature.

What is claimed is:

1. A magnetic divider system for forming one or more sub-compartments to isolate and organize articles therewithin in the interior region of a compartment having a substantially planar ferruginous surface, said magnetic divider system comprising:

at least one rail member for defining one or more sub-compartments in the interior region of the compartment, said at least one rail member having a substantially planar base portion and a distal portion, said base portion capable of being restrainably affixed to the ferruginous surface of the interior region of the compartment with said distal portion extending substantially normally away from the ferruginous surface, without requiring said at least one rail member to engage with the compartment beyond the ferruginous surface; and one or more attachment members for fixedly restraining said at least one rail member along the ferruginous surface in the interior region of the compartment, said one or more attachment members comprising one or more magnets, at least one of said one or more magnets including a flat surface adjacent said base portion, the flat surface is substantially parallel to said ferruginous surface, upon affixation of said at least one rail member thereto, said one or more attachment members being integrally pre-positioned along said base portion of said at least one rail member prior to the juxtapositioning of said rail member to said ferruginous surface and without preliminarily affixing said one or more attachment members to the ferruginous surface, said one or more attachment members restrainably affixing said at least one rail member to the ferruginous surface of the interior region of the compartment independent of the engagement of said at least one rail member with the compartment beyond the ferruginous surface, said at least one rail member defining at least one sub-compartment bounded along the bottom by the ferruginous surface in the interior region of the compartment;

said at least one rail member capable of dividing the interior region of the compartment magnetically along the ferruginous surface by itself as well as in cooperation with other like rail members, said at least one rail member capable of dividing the interior region of the compartment by magnetically engaging the ferruginous surface thereof while being free of engagement with the compartment beyond the ferruginous surface, said at least one rail member capable of being sized to a desired length.

2. The magnetic divider system of claim 1, further comprising:

at least two of said rail members capable of being cooperatively configured to form one or more sub-compartments in the interior region of the compartment, said at least two rail members being fixedly restrained on the ferruginous surface of interior region of the compartment and being arranged to intersect; and one or more cover fittings for further restraining said at least two rail members, said one or more cover fittings having a plan shape corresponding to an intersection of said at least two rail members and having a generally U-shaped cross-section complementary to said distal portions of said at least two rail members, said one or more cover fittings telescopically overlaying said at least two rail members at said intersection and securing said at least two rail members to each other.

3. The magnetic divider system of claim 2, wherein said plan shape of said one or more cover fittings is an L-shape, said L-shape having a first cover segment and a second cover segment fixed at an ending of the first cover segment, said first and second cover segments being substantially perpendicular to each other, each of said first and second cover segments capable of telescopically overlaying at least one of said rail members.

4. The magnetic divider system of claim 2, wherein said plan shape of said one or more cover fittings is a T-shape, said T-shape having a first cover segment and a second cover segment fixed at a central portion of the first cover segment, said first and second cover segments being substantially perpendicular to each other, each of said first and second cover segments capable of telescopically overlaying at least one of said rail members.

5. The magnetic divider system of claim 2, wherein said plan shape of said one or more cover fittings is a cross-shape, said cross-shape having a first cover segment and a second cover segment fixed together at central portions thereof, said first and second cover segments being substantially perpendicular to each other, each of said first and second cover segments capable of telescopically overlaying at least one of said rail members.

6. The magnetic divider system of claim 2, wherein said plan shape of said one or more cover fittings is a Y-shape, said Y-shape having a first cover segment, a second cover segment, and a third cover segment fixed together at a junction, each of said first, second, and third cover segments capable of telescopically overlaying at least one of said rail members.

7. The magnetic divider system of claim 2, wherein said one or more cover fittings include protrusions for restrainably engaging said at least two rail members when telescopically overlaying said at least two rail members, said protrusions extending inwardly from opposing positions of interior surfaces of said one or more cover fittings, said at least two rail members including notches for receiving said protrusions, said notches being disposed at opposing positions in outer surfaces of said at least two rail members, said protrusions and said notches capable of engaging and restraining said one or more cover fittings relative to said at least two rail members when said one or more cover fittings telescopically overlays said at least two rail members.

8. The magnetic divider system of claim 1, wherein said at least one rail member has a channel extending therethrough, said channel being proximate said base portion and spaced apart from said distal portion, said channel having a key-shaped cross-section, said key-shaped cross-section tapering in a direction from said distal portion toward said base portion.

9. The magnetic divider system of claim 8, wherein said one or more attachment members have a key-shaped cross-section complementary to said key-shaped cross-section of said channel.

10. The magnetic divider system of claim 8, wherein said channel bisects said base portion.

11. The magnetic divider system of claim 8, wherein said channel is spaced apart from said base portion with said key-shaped cross-section of said channel extending wholly within said rail member.

12. The magnetic divider system of claim 1, wherein said one or more attachment members comprise permanent magnets.

13. The magnetic divider system of claim 1, wherein said at least one rail member has a channel extending therethrough, said channel extending continuously along said at least one rail member, said at least one rail member capable of being sized to a desired length by a user, with said channel extending continuously over said desired length.

14. The magnetic divider system of claim 1, wherein said distal portion of said at least one rail member has a rounded shape.

15. The magnetic divider system of claim 1, wherein the compartment is a drawer having a ferruginous-surfaced drawer bottom.

16. The magnetic divider system of claim 14, wherein the compartment is a metal drawer.

17. The magnetic divider system of claim 14, wherein the compartment is a tool box drawer.

18. The magnetic divider system of claim 1, wherein the compartment is a bed of a pick-up truck.

19. The magnetic divider system of claim 1, further comprising:

one or more end caps for covering an end surface of said at least one rail member, said one or more end caps having a plan shape corresponding to an length of said at least one rail member and having a generally U-shaped cross-section complementary to said distal portion of said at least one rail member, said one or more end caps telescopically overlaying said at least one rail member and covering said end surface of said at least one rail member.

* * * * *